US008967094B2

(12) United States Patent
Tofukuji et al.

(10) Patent No.: US 8,967,094 B2
(45) Date of Patent: Mar. 3, 2015

(54) INTERNAL COMBUSTION ENGINE

(75) Inventors: Satoko Tofukuji, Susono (JP); Atsunori Kumagai, Sunto-gun (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 302 days.

(21) Appl. No.: 13/503,792

(22) PCT Filed: Oct. 27, 2009

(86) PCT No.: PCT/JP2009/068426
§ 371 (c)(1),
(2), (4) Date: Apr. 24, 2012

(87) PCT Pub. No.: WO2011/052041
PCT Pub. Date: May 5, 2011

(65) Prior Publication Data

US 2012/0204821 A1 Aug. 16, 2012

(51) Int. Cl.
*F02B 75/18* (2006.01)
*F02F 1/14* (2006.01)
(Continued)

(52) U.S. Cl.
CPC ..... *F02F 1/14* (2013.01); *F01P 2003/021* (2013.01); *F02F 2001/104* (2013.01); *F05C 2251/046* (2013.01); *F01P 3/02* (2013.01)
USPC ..... 123/41.74; 123/41.79

(58) Field of Classification Search
CPC ..... F01P 3/02; F01P 2003/021; F02F 1/10; F02F 1/14; F02F 1/16; F02F 1/108; F02B 2075/1816; F02B 75/22; F02B 3/06
USPC ..... 123/41.72, 41.74, 41.79
See application file for complete search history.

(56) References Cited

U.S. PATENT DOCUMENTS 6,481,392 B1 * 11/2002 Etemad ..... 123/41.74
6,758,173 B2 * 7/2004 Saito et al. ..... 123/41.74
(Continued)

FOREIGN PATENT DOCUMENTS

CN 101307714 A 11/2008
JP 64-34423 U 3/1989
JP 01-249944 A 10/1989
JP 2002-013440 A 1/2002
(Continued)

OTHER PUBLICATIONS

International Search Report of PCT/JP2009/068426 of Dec. 8, 2009.

*Primary Examiner* — Noah Kamen
(74) *Attorney, Agent, or Firm* — Sughrue Mion, PLLC

(57) ABSTRACT

A ringed coolant water passage 16 formed to surround a plurality of cylinders #1-#4 is provided. Two partitioning members having a larger thermal expansion coefficient as compared to that of a cylinder block 10, and separating the ringed coolant water passage 16 into first passage 22 and second passage 24 is provided. The first passage 22 exists mainly at one side of a longitudinal bore center plane which extends along the longitudinal direction of the cylinder block 10 while the second passage 24 exists mainly at the other side. An inlet which communicates with the first passage and an outlet which communicates with the second passage are provided. A cylinder head including a coolant water passage which opens to both of the first passage 22 and the second passage 24 is attached to the cylinder block 10. The cylinder block 10 and the partitioning members 12, 14 are formed so that stress acting between both of them in a condition where the internal combustion engine is warmed up does not reach to a breaking stress of the partitioning members 12, 14.

7 Claims, 8 Drawing Sheets

(51) Int. Cl.
*F01P 3/02* (2006.01)
*F02F 1/10* (2006.01)

(56) References Cited

U.S. PATENT DOCUMENTS

| | | | |
|---|---|---|---|
| 2002/0000210 | A1 | 1/2002 | Shinpo et al. |
| 2008/0283001 | A1 | 11/2008 | Konishi et al. |
| 2010/0242868 | A1 | 9/2010 | Shikida et al. |

FOREIGN PATENT DOCUMENTS

| | | | |
|---|---|---|---|
| JP | 2002-161743 | A | 6/2002 |
| JP | 2002-161803 | A | 6/2002 |
| JP | 2002-266695 | A | 9/2002 |
| JP | 2005-030297 | A | 2/2005 |
| JP | 2005273469 | A | 10/2005 |
| JP | 2006-090195 | A | 4/2006 |
| JP | 2008-025474 | A | 2/2008 |

* cited by examiner

INTERNAL COMBUSTION ENGINE

CROSS REFERENCE TO RELATED APPLICATIONS

This application is a National Stage of International Application No. PCT/JP2009/068426 filed Oct. 27, 2009, the contents of all of which are incorporated herein by reference in their entirety.

TECHNICAL FIELD

The present invention relates to an internal combustion engine, particular to an internal combustion engine having a cooling system that is suitable to an internal combustion engine of the water cooling type.

BACKGROUND ART

An internal combustion engine in which coolant water is circulated by a way of so-called breadthwise flowing is described in Japanese Utility Model Laid-Open publication No. 64-34423. More particularly, the above publication discloses a cylinder block having three cylinders placed in series. This cylinder block is provided with two coolant water passages independent of each other on either side of the three cylinders. One of the coolant water passages is equipped with an inlet of coolant water. The other coolant water passage is equipped with an outlet of the coolant water.

A cylinder head is attached to the cylinder block. The cylinder head is provided with coolant water passages for cooling down surroundings of valve systems installed therein. Usually, this coolant water passage delivers and receives coolant water to and from coolant water passages in the cylinder block. According to the internal combustion engine disclosed by the above described publication, coolant water supplied to the inlet initially flows through inside of the coolant water passage installed in one side (it is assumed exhaust side) of the cylinder block. Subsequently, the coolant water flows into the coolant water passage in the cylinder head from openings provided at its exhaust side. The coolant water flowing through the inside of the cylinder head flows into the other side of the cylinder block, that is, into the coolant water passage installed in the intake side from intake side openings. The coolant water circulates along sides of the cylinders afterwards, so as to flow out from the outlet. As described above, the internal combustion engine disclosed by the publication can circulate the coolant water around the cylinder and the valve system by the way so-called breadthwise flowing.

As a technique to circulate coolant water inside of the internal combustion engine, the technique of so-called lengthwise flowing is known other than the technique of the breadthwise flowing. At Japanese Patent Laid-Open publication No. 2002-161743, an internal combustion engine in which coolant water is circulated by the technique of lengthwise flowing is disclosed. In this internal combustion engine, a ringed coolant water passage that is formed to surround a plurality of cylinders is provided to the cylinder block. In this case, the coolant water circulates along ringed coolant water passage so as to cool down the plurality of cylinders without distinguishing passage of the exhaust side from the passage of the intake side.

Patent document 1: Japanese Utility Model Laid-Open publication No. 64-34423

Patent document 2: Japanese Patent Laid-Open publication No. 2002-161743

DISCLOSURE OF THE INVENTION

Problem to be Solved by the Invention

As described above, it is necessary to provide a cylinder block with two coolant water passages that are independent each other for making coolant water circulate by the technique of the breadthwise flowing. On the other hand, when the technique of the lengthwise flowing is used, it is necessary to provide to the intake side and the exhaust side of the cylinder with coolant water passages which communicates each other so as to be ringed. Thus, cylinder blocks must be manufactured according to a specialized design for adopting the breadthwise flowing or for adopting the lengthwise flowing, respectively.

The present invention has been made to solve the above described problem. It is an object of the present invention to provide an internal combustion engine which can circulate coolant water by the technique of the breadthwise flowing while using a cylinder block that can be converted into for the lengthwise flowing purpose.

Means for Solving the Problem

To achieve the above mentioned purpose, the first invention is an internal combustion comprising:

a cylinder block equipped with a ringed coolant water passage formed so as to surround a plurality of cylinders;

two partitioning members having a larger thermal expansion coefficient as compared to that of said cylinder block, and separating said ringed coolant water passage into first passage existing mainly at one side of a longitudinal bore center plane which extends along the longitudinal direction of said cylinder block and second passage existing mainly at the other side of said longitudinal bore center plane;

an inlet which communicates with said first passage;

an outlet which communicates with said second passage; and a cylinder head provided with a coolant water passage opening to both said first passage and said second passage, wherein said cylinder block and said partitioning members are manufactured so that stress acting between both of them in a condition where the internal combustion engine is warmed up does not reach to a breaking stress of said partitioning member.

The second invention is the internal combustion engine according to the first invention, wherein at least one of said cylinder block and said partitioning member includes stress lowering means which absorb by elastically deforming relative dimensional change occurring between the both of them between a cold condition and a warmed up condition.

The third invention is the internal combustion engine according to the first or second invention, wherein a gap is formed between said cylinder block and said partitioning member under a cold condition.

The fourth invention is the internal combustion engine according to any one of the first to third aspects of the present invention, wherein a gap is formed between said cylinder block and said partitioning member under a warmed up condition.

The fifth invention is the internal combustion engine according to any one of the first to fourth aspects of the present invention, wherein said partitioning member comprises a main body having rigidity and an elastic portion attached to said main body.

The sixth invention is the internal combustion engine according to any one of the first to fifth aspects of the present invention, wherein said partitioning member is formed of a base material and a heat conduction material having high heat conductivity as compared to that of the base material so as to show a high heat conductivity as compared to that of the base material itself between said first passage and said second passage.

The seventh invention is the internal combustion engine according to any one of the first to sixth aspects of the present invention, wherein said inlet is provided in said other side at a vicinity of a longitudinal directional end of said cylinder block, and one of said two partitioning members is placed in said other side at a place where is closer to the center of the internal combustion engine than a connecting portion of said inlet and said ringed coolant water passage is.

The eighth invention is the internal combustion engine according to any one of the first to seventh aspects of the present invention, wherein said inlet is provided at a vicinity of one end in a longitudinal direction of said cylinder block, said outlet is provided at a vicinity of the other end in the longitudinal direction of said cylinder block, one of said two partitioning members is placed at a vicinity of said inlet, and the other of said two partitioning members is placed in said one side at a position where is closer to said outlet than an other-end crosswise bore center plane which is perpendicular to said longitudinal bore center plane while extending through a bore center of the cylinder closest to said other end in the longitudinal direction is.

Advantages of the Invention

According to the first invention, coolant water supplied from the inlet can be circulated to the cylinder block from the first passage installed in one side of the cylinder block; further the same can be circulated from the cylinder head to the second passage which is installed in the other side of the cylinder head. Further, the cylinder block employed for the present invention can be converted into a cylinder block for the so-called lengthwise flowing purpose if no partitioning means are attached, because of having the ringed coolant water passage. Additionally, the cylinder block and the partitioning members do not suffer the breaking stress even under a wormed up state, regardless the thermal expansion coefficients of the both are different. Thus, the present invention can circulate the coolant water by the way so-called breadthwise flowing while assuring sufficient durability.

According to the second invention, at least one of the cylinder block and the partitioning members can be elastically deformed. Thus, the present invention can surely prevent the stress acting between the both from reaching the breaking stress of the partitioning members.

According to the third invention, the cylinder block and the partitioning members are formed so that a gap occurs between the both under a cold condition. Because of this, the partitioning members can be easily installed in the cylinder block according to the present invention. A bubble mixed in, for example, when coolant water is interchanged may be remained at the place of the partitioning members. According to the present invention, it is possible to remove such a bubble immediately after cold staring, thereby preventing cooling capability from being deteriorated. Further, the gap discussed above is reduced as warm up advances since the partitioning members get expand. Thus, it is possible to circulate sufficient amount of coolant water through the cylinder head in a warmed up condition since the coolant water amount directly flowing into the second passage from the first passage is reduced enough.

According to the fourth invention, a gap is formed between the cylinder block and the partitioning members in a wormed up condition. The present invention can generate a coolant water current around the partitioning members in the warmed up condition, in addition to implement the effects achieved by the third invention. Thus, the present invention can prevent the partitioning members from being overheated, thereby improving the durability thereof.

According to the fifth invention, the partitioning members include the elastic portion other than the main body having rigidity. Thus, according to the present invention, a change of dimension occurring in the partitioning members due to the difference of the expansion coefficient, or dimension variations of the partitioning members due to fabrication tolerance can be absorbed by the elastic portion.

According to the sixth invention, heat exchange can be effectively caused through the heat conduction material between the first passage and the second passage separated by the partitioning members. Thus, the present invention can effectively prevent the coolant water temperatures of the first passage and the second passage from being largely different each other, while forming the partitioning members using the main body having a low heat conductivity.

According to the seventh invention, the portion of the ringed coolant water passage at which the passage is connected to the inlet can be a part of the first passage in a case where the inlet which should be connected to the first passage is located in the second passage side due to an unavoidable circumstance. Thus, according to the present invention, it is possible to realize an efficient cooling system even under the above described unavoidable circumstance.

According to the eighth invention, the coolant water flowing into the first passage of the cylinder block from a vicinity of an upstream side end (one end) goes through the cylinder head to flow into the second passage, then backs into the cylinder head again at a vicinity of a downstream side end (the other end) so as to flow out from the outlet provided to the cylinder head. According to the present invention, it is possible to extend the second passage so as to largely come around between the end of the cylinder block and the cylinder located at the end. It is necessary that the second passage opens largely to a passage in the cylinder head which communicates with the outlet, in order to assure sufficient ability of coolant water draining. According to the configuration of the present invention, the opening in question can be made large, without taking measures such as expanding the width of the ringed coolant water passage at the vicinity of the above described other end. The present invention, therefore, can provide a sufficient draining ability without increasing the coolant water amount uselessly, thereby improving warming up characteristics of the internal combustion engine.

DESCRIPTION OF REFERENCE NUMERALS

10; 90 cylinder block

Figure 1A:
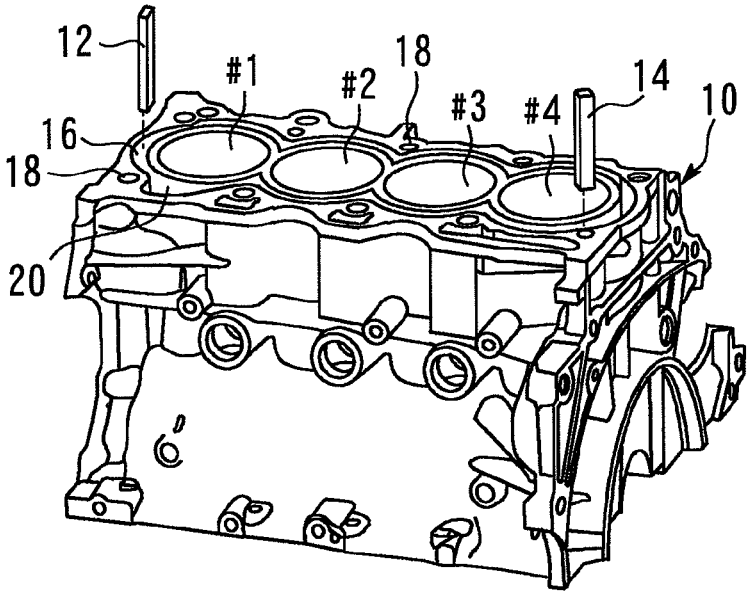
FIG. 1A is a drawing showing a cylinder block and partitioning members employed in a first embodiment of the present invention.

12, 14, 48, 50; 68, 70; 76; 80, 84; 88 partitioning member

44, 46; 60, 62 partitioning protrusion

16; 92 ringed coolant water passage

20; 94 connecting portion

22; 98 first passages

24; 100 second passages

25; 102 come around portion

54; 64, 66; 72, 74 elastic material

78 coating

82; 86 core

Best Mode For Carrying Out The Invention

First Embodiment

[Configuration of First Embodiment]

FIG. 1A shows a cylinder block 10 employed in a first embodiment of the present invention and two partitioning members 12, 14 attached thereon. As shown in FIG. 1A, the cylinder block 10 has four cylinders #1-#4 lining up in series. There is formed around the four one cylinder #1-#4 a ringed coolant water passage 16 which is formed circumferentially to surround all of them. A plurality of head bolt holes 18 are provided at almost equal intervals further outside of the ringed coolant water passage 16.

A cylinder head which is not illustrated is attached to a top of the cylinder block 10. The head bolt holes 18 are used to which head bolts are tighten for fixing the cylinder head. The cylinder head is subjected to combustion pressure of the internal combustion engine. Thus, portions around the head bolt holes 18 are subjected to great force. If the force is transmitted to walls of the cylinders #1-#4, shape of the walls will be changed. Because of this, the ringed coolant water passage is formed so as to have enough depth so that the force acting around the head bolt holes 18 is not transmitted to the walls of the cylinders #1-#4 directly.

In FIG. 1A, the cylinders #1-#4 are provided with intake valves (not shown) placed at back side in the drawing as well as exhaust valves (not shown) placed at front side in the drawing, respectively. Hereinafter, a plane spreading along the longitudinal direction of the cylinder block 10 and going through the bore centers of the cylinders #1-#4 will be called "longitudinal bore center". Further, across the longitudinal bore center, the back side in the drawing will be called "intake side" while the front side in the drawing will be called "exhaust side".

A connecting portion 20 for connecting an inlet of coolant water and the ringed coolant water passage 16 is provided at the exhaust side of the cylinder #1. Coolant water can be supplied to the ringed coolant water passage 16 from the connecting portion 20 through the inlet.

In the present embodiment, two partitioning members 12, 14 are put into the ringed coolant water passage 16. The partitioning members 12, 14 have a length corresponding to the depth of the ringed coolant water passage 16 and a thickness corresponding to the width thereof.

Figure 1B:
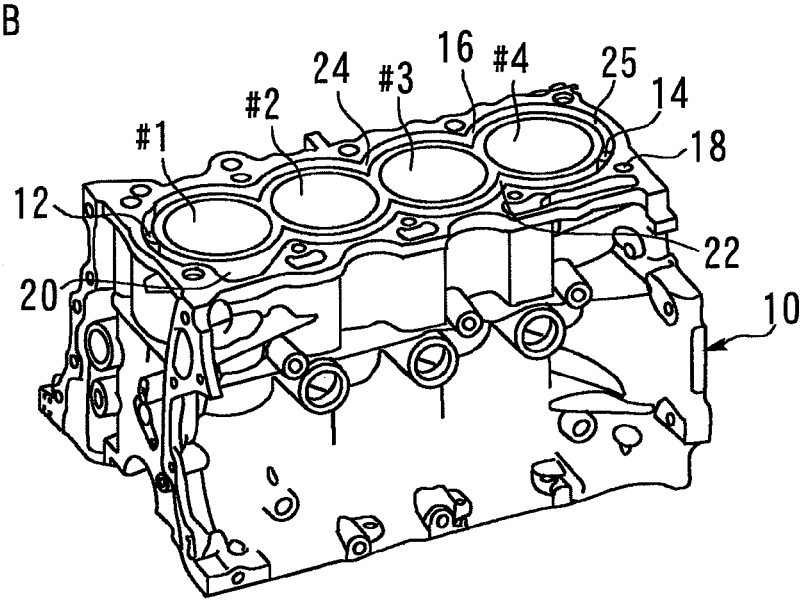
FIG. 1B is a drawing showing a state in which the partitioning members are attached to the cylinder block included in an internal combustion engine according to the first embodiment of the present invention.

FIG. 1B shows a state in which the partitioning members 12, 14 are put into the ringed coolant water passage 16. As shown in FIG. 1B, one partitioning member 12 is attached to the ringed coolant water passage 16 at an end of the cylinder #1 side in the longitudinal direction. The other partitioning member 14 is put into the vicinity of the head bolt hole 18 provided in the exhaust side (front side in the drawing) near the end of the cylinder #4 side. The partitioning members 12, 14 have the length and thickness corresponding to the depth and width of the ringed coolant water passage 16, as stated above. Accordingly, the ringed coolant water passage 16 is substantially separated to two passages when the partitioning members 12, 14 are put on. Hereinafter, among those passages, the passage mainly extending through the front side in the drawing (the exhaust side) is called "first passage 22" while the passage mainly extending through the back side in the drawing (the intake side) is called "second passage 24".

A region of the ringed coolant water passage 16 mainly extending through the exhaust side of the cylinders becomes the first passage 22 when the partitioning members 12, 14 are put into the position described above. Likely, a region of the ringed coolant water passage 16 mainly extending through the intake side of the cylinders becomes the second passage 24. Further, a region of the ringed coolant water passage 16 between two head bolts 18 provided near the cylinder #4 side end becomes a part of the second passage 24. Hereafter, the region between the two head bolts 18 is called "come around portion 25".

Figure 1C:
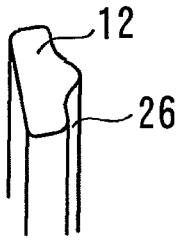
FIG. 1C is a perspective view showing the partitioning members employed in the first embodiment of the present invention.

FIG. 1C shows an enlarged view of the partitioning member 12. As shown in FIG. 1C, the partitioning member 12 is provided with a rail portion 26 projecting in a convex shape. A groove of a concave shape corresponding to the rail portion 26 is formed on the wall of the ringed coolant water passage 16 at a position where the partitioning member 12 is attached to. The partitioning member 12 is inserted into the ringed coolant water passage 16 so that the rail portion 26 goes in along the groove.

The cylinder block 10 is formed of metal such as cast iron or aluminum. On the other hand, the partitioning member 12 is formed of material having a greater thermal expansion coefficient as compared to the material of the cylinder block 10, for example, PP, PA66, PA6, PA66GF33. The assembly of the partitioning member 12 is performed at room temperature. The partitioning member 12 is formed so that a gap of a little less than 1 mm is formed between it and the wall when being put into the ringed coolant water passage 16 under normal temperature.

In the present embodiment, the ringed coolant water passage 16 has a width of around 6 to 8 mm. Since the gap between the partitioning member 12 and the wall of the ringed coolant water passage 16 is of a little less than 1 mm, the ringed coolant water passage 16 can be assumed to be substantially divided into both sides of the partitioning member 12 at a time when the internal combustion engine is driven with a requirement of a large amount of circulation of coolant water. It should be noted that the partitioning member 12 is an element used to substantially close the ringed coolant water passage 16 partially, and satisfies its requirement when being capable of lowering the effective area of the ringed coolant water passage 16 to an extent of equal to or less than ⅙, or equal to or less than ⅛ under normal temperature, like in the present embodiment. Further, a member which lowers the effective area of the ringed coolant water passage 16 to about ¼ may employed as the partitioning member 12 in the present embodiment depending on ability for coolant water required in the internal combustion engine.

In a warming up process of the internal combustion engine, the partitioning member 12 expands greatly as compared to the cylinder block 10. In a stage in which warming up has completed, the partitioning member 12 will be exposed to coolant water of around 85 degrees Celsius. In the present embodiment, the partitioning member 12 is formed so that a gap remains between it and the wall of the ringed coolant water passage 16 even in such a temperature environment.

[Current of Coolant Water in First Embodiment]

Figure 2A:
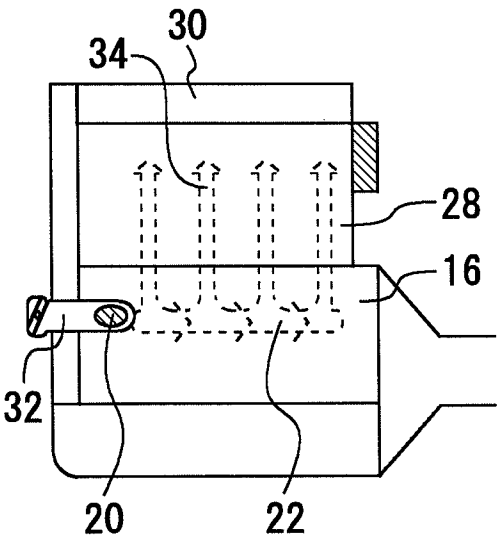
FIG. 2A is a drawing showing from a side of intake valves a coolant water circulating passage in the first embodiment of the present invention.
Figure 2B:
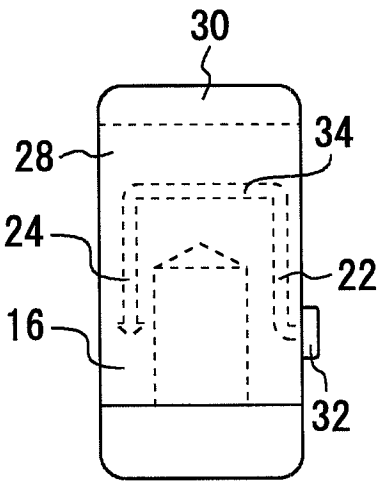
FIG. 2B is a drawing showing from front the coolant water circulating passage in the first embodiment of the present invention.
Figure 2C:
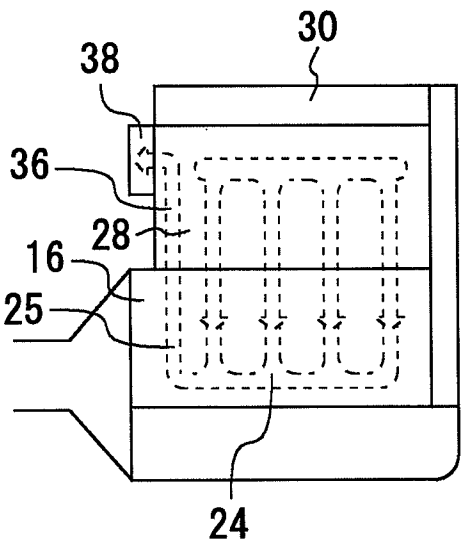
FIG. 2C is a drawing showing from a side of exhaust valves the coolant water circulating passage in the first embodiment of the present invention.

FIG. 2A through FIG. 2C are drawings to explain the course of coolant water flowing through the inside of the internal combustion engine according to the present embodiment. In these drawings, a cylinder head 28 is equipped with on the cylinder block 16. Further, the upper part of the cylinder head 28 is covered by a cylinder-head cover 30.

FIG. 2A shows an exhaust side of the internal combustion engine according to the present embodiment. The cylinder block 16 has the first passage 22 in the exhaust side as stated above (see FIG. 1B). The first passage 22 extends along the longitudinal direction of the cylinder block 16 while being connected to the inlet 32 of coolant water through the connecting portion 20 at one end thereof.

The cylinder head 28 is provided with a coolant water passage 34 having openings which face to the first passage 22. The coolant water supplied from the inlet 32 flows through the first passage 22 so as to spread out all over one side (the exhaust side) of the cylinder block 16, then flowing from all regions of the first passage 22 into the coolant water passage 34, that is, into the cylinder head 28.

FIG. 2B is a drawing which shows a plane view of the internal combustion engine according to the present embodiment. As shown in FIG. 2B, the coolant water passage 34 is formed so as to cross the cylinder head 28 in the crosswise direction and communicate with the second passage 24 of the cylinder block 16 on the intake side (the left side in the drawing) of the cylinder. Thus, the coolant water flows into the cylinder head 28 from the cylinder block 16 on the exhaust side (the right side in the drawing) of the cylinder, then flowing out from the cylinder head 28 to the cylinder block on the intake side of the cylinder.

FIG. 2C shows a side view of the intake side of the internal combustion engine according to the present embodiment. The coolant water flowing back from the cylinder head 28 to the cylinder block 16 goes through the second passage 24 so as to spread out all over the other side (the intake side) of the cylinder block 24. The second passage 24 of cylinder block 16 has the come around portion 25 which comes around between the cylinder #4 and the end of the cylinder block 16, as stated above (see, FIG. 1B). The cylinder head 28 is provided with a draining passage 36 communicating with the second passage 24 at the come around portion 25. Further, the drain passage 28 is provided with an outlet 38 of the coolant water. The come around portion 25 is located at the most downstream position in the current of the coolant water. Accordingly, the coolant water flowing into from the inlet 32 circulates through the interior of the cylinder block 16 and the cylinder head 28, and then finally arrives at the come around portion 25 so as to be drained from the outlet through the drain passage 36 of the cylinder head 28.

[Problem in the Breadthwise Flowing]

As described above, the internal combustion engine according to the present embodiment can circulate coolant water by order of: the exhaust side of the cylinder block → the exhaust side the cylinder head → the intake side of the cylinder head → the intake side of the cylinder block. In other words, this internal combustion engine can circulate coolant water by the technique of so-called breadthwise flowing. Such a breadthwise flowing of coolant water can be also implemented by forming partitions which separate the first passage 22 of the exhaust side and the second passage 24 of the intake side integrally with a cylinder block at a stage of such as casting.

However, a bubble may be mixed into coolant water, for example, when it is changed. A bubble once gets to a partition is not readily removed from there, since the partition acts as a member for shutting off the current of the cooking water. In this case, the cooling ability of the internal combustion engine may be deteriorated because of the bubble. The problem of the bubble appears particularly in an internal combustion engine, such as a V-type engine, in which a cylinder block is placed so that cylinders are slanted.

The problem of the bubble described above can be solved, for example, by providing a gap of the extent to permit the flowing through of the bubble to the partition formed from the beginning by casting or the like. On the other hand, such a gap acts as a passage which allows the coolant water flowing through from the first passage 22 to the second passage 24 directly. In other words, the gap forms a passage bypassing the coolant water passage in the cylinder head within a coolant water system employing the technique of the breadthwise flowing. Thus, it is desirable that the gap is small in order to improve the cooling efficiency of the cylinder head. Specially, it is desirable that the gap is sufficiently small after completion of warming up when high cooling efficiency is required.

If the partitions which divide the coolant water passage in the cylinder block into two are integrally made in a process of such as casting, the material of the partitions should be the same as the material of the cylinder block body. In a case where a gap is provided to the position of the partitions under such a condition, its size will be almost the same in a cold state or in a warmed up state. Thus, if a gap is increased to raise the removing ability of the bubble, the cooling ability in the warmed up state will be deteriorated, whereas if much value is placed on the cooling ability in the warmed up state, the removable ability of the bubble goes low.

In contrast, forming the partitions separating the coolant water passage with a material having a higher heat expansion coefficient as compared to that of the material of the cylinder block makes it possible that assuring a large gap in a cold state and reducing the gap as warm up process advances. Such partitions are capable of assuring great bubble removing ability in a cold state as well as realizing efficient cooling ability after completion of warming up.

In the present embodiment, therefore, the partitioning members 12, 14 are formed so that the following requirements are satisfied.

First Requirement. Forming the partitioning members 12, 14 with a material (or materials) having a higher heat expansion coefficient as compared to that of the material of the cylinder block 10.

Second Requirement. A gap (preferably, of about a little less than 1 mm) is provided between the wall of the coolant water passage 16 and the partitioning members 12, 14 under normal temperature (at the time of cold staring).

According to the configuration of the present embodiment, the following effect can be obtained since the requirements described above are satisfied.

First Effect. The removing capability of bubbles mixed into coolant water is high.

Second Effect. Cooling capability after completion of warming up can be secured enough.

Moreover, the effect such as follows can be also obtained if the first and second requirements discussed above are satisfied.

Third Effect. Assembly characteristics of the partitioning members 12, 14 to the cylinder block 10 under normal temperature 3 will be improved.

Fourth Effect. The Cylinder block 10 can be used as a block of an internal combustion engine in which the technique so-called lengthwise flowing is employed when one of the partitioning members 12, 14 is not put on, or none of them is put on. The issue of whether to use the lengthwise flowing or the breadthwise flowing as a technique to circulate coolant water will be determined depending on various conditions. The configuration of the present embodiment can vanish the necessity of manufacturing cylinder blocks specialized for use of the lengthwise flowing and cylinder blocks specialized for use of the breadthwise flowing independently, thereby realizing a large amount of cost cut when manufacturing various types of internal combustion engines is a presupposition.

Further, the partitioning member 12, 14 in the present embodiment are subject to the following third requirement as well as the first and second requirement described above.

Third Requirement. A gap remains between the partitioning members 12, 14 and the wall of the ringed coolant water passage 16 even after completion of warming up.

According to the configuration of the present embodiment, the following effect can be further achieved by being subject to the above described third requirement.

Fifth Effect. A stress is prevented from arising between the partitioning members 12, 14 and the cylinder block 10 at a stage after completion of warming up. In other words, breaking stress due to thermal expansion is prevented from acting to the partitioning members 12, 14, whereby the partitioning member 12, 14 obtain enough durability.

Sixth Effect. It is possible to flow appropriate amount of coolant water near the partitioning members 12, 14 at a stage after completion of warming up. In a configuration in which coolant water can not flow near the partitioning members 12, 14, heat is accumulated near there whereby the partitioning members 12, 14 are apt to be damaged due to overheat. In contrast, in a case where coolant water can circulate near there, it is possible to prevent the heat from accumulating; thereby preventing the partitioning members 12, 14 from being damaged due to overheat.

[Alternatives]

Although it is described in the first embodiment that gaps remain between the wall of the ringed coolant water passage 16 and the partitioning members 12, 14, the present invention is not limited to this. That is, the gap discussed above may vanish at the time of completion of warming up in the extent that breaking stress due to thermal expansion does not occur, if the problem of overheat of the partitioning members 12, 14 due to accumulation of heat does not arise after completion of the warming up.

Further, although the partitioning members 12, 14 are made of a material or materials showing higher heat expansion coefficient as compared to the cylinder block 10 in the above described first embodiment, the present invention is not limited to this. That is, the partitioning members 12, 14 may be made of a same material as that of the cylinder block 10 so as to be removable, and may be attached so that an appropriate gap is formed, under a condition in which sufficient bubble removable effect and enough cooling capability can be obtained even if a gap in a cold state is the same as a gap in a warmed up state.

Further, although a gap is formed between the wall of the coolant water passage 16 and the partitioning members 12, 14 under normal temperature in the above described first embodiment, but the present invention is not limited to this. In a case where the problem of the remaining bubbles will not occur, for example, since cylinders are provided in a vertical state in an internal combustion engine, the partitioning members 12, 14 may be formed of a material same as that of the cylinder block 10; further the partitioning members 12, 14 may be attached to the ringed coolant water pa passage 16 so that no gap is produced.

Second Embodiment.

Figure 3A:
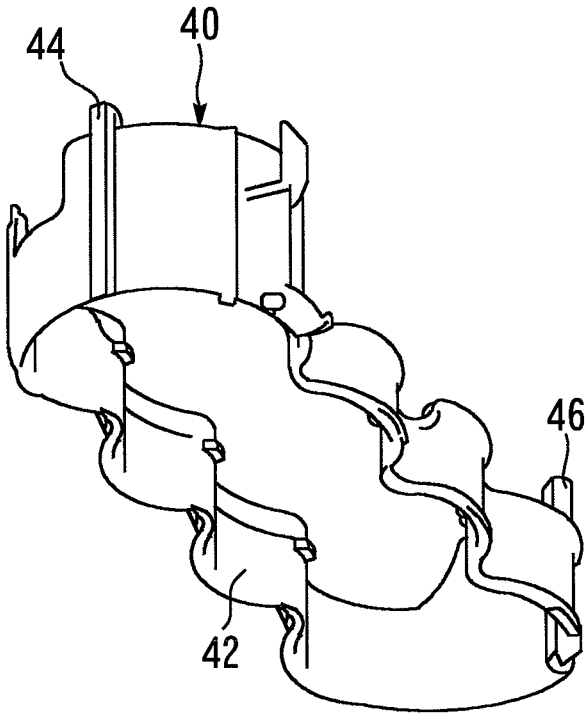
FIG. 3A is a perspective view from a down oblique direction showing a water jacket spacer (W/J spacer) employed in a second embodiment of the present invention.
Figure 3B:
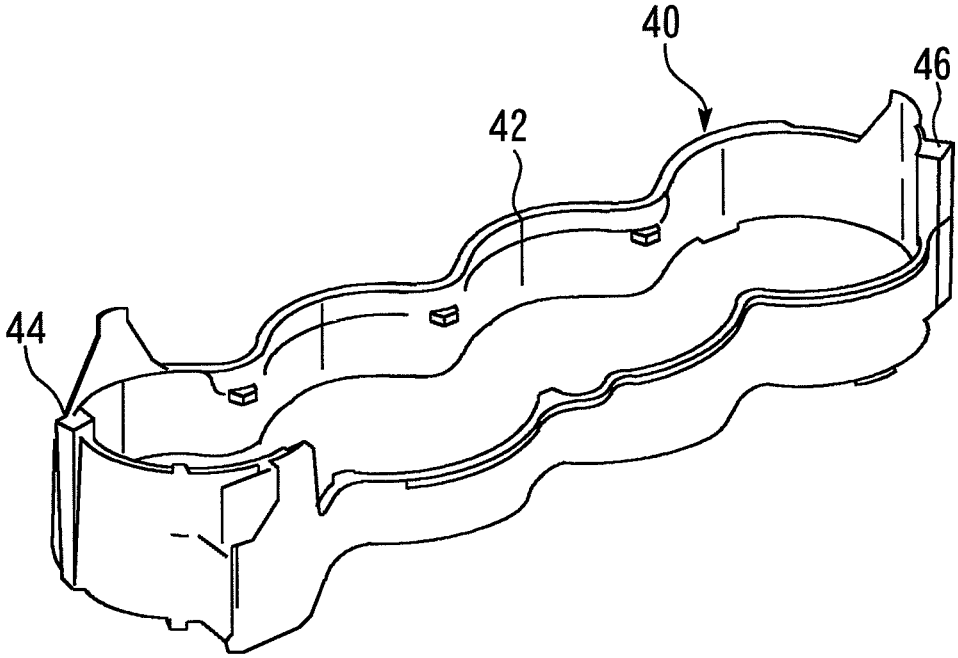
FIG. 3B is a perspective view from an up oblique direction showing the W/J spacer employed in the second embodiment of the present invention.

Next, there will be explained a second embodiment of the present invention, with reference to FIG. 3A and FIG. 3B. FIG. 3A is a perspective view from a down oblique direction showing a water jacket spacer (W/J spacer) 40 employed in the present embodiment. FIG. 3B is a perspective view from an up oblique direction showing the W/J spacer 40.

The internal combustion engine according to the present embodiment can be realized by attaching the W/J spacer 40 to the cylinder block 10 in substitution for the partitioning members 12, 14, in the configuration of the first embodiment described above. The W/J spacer 40 includes a body section 42 received into the ringed cooling water passage 16 shown in FIG. 1A. The body part 42 is provided with two partitioning protrusions 44, 46. The body part 42 and the partitioning protrusions 44, 46 are formed of a material same as that of the partitioning members 12, 14 in the first embodiment, that is, a material with a higher heat expansion coefficient as compared to that of the cylinder block 10, such as PP, PA66, PA6, PA66GF33.

The body 42 of the W/J spacer 40 is constructed so as to reduce the effective area of the ringed coolant water passage 16 in the whole region at a required rate. More specifically, the body 42 is formed so that no part of the ringed coolant water passage 16 is substantially closed. In the first embodiment, the partitioning members 12, 14 are subjected to the requirement of reducing the effective area of the ringed coolant water passage 16 to less than or equal to one four of the original one. In contrast, the body 42 does not reduce the effective area of the ringed coolant water passage 16 to one fourth thereof at any part.

As stated above, the ringed coolant water passage 16 is given enough depth in order to avoid that the stress acting to the head bolt hole 18 is undesirably transmitted to the outer wall of the cylinder. As a result, the ringed coolant water passage 16 may be given surplus volume in some cases compared to the necessary cooling capability. When the ringed coolant water passage 16 has surplus volume, the amount of circulating water becomes superabundant, which uselessly deteriorates the warming up characteristics of the internal combustion engine while causing problems of increasing the weight of a vehicle idly. Thus, it is desirable that the volume of the ringed coolant water passage 16 is one which is necessary and sufficient to the required cooling capability.

The body 42 of the W/J spacer 40 is an element that was designed to satisfy such a requirement. Thus, when the W/J spacer 40 is put into the ringed coolant water passage 16, the effective volume of the passage can be set to an appropriate amount which corresponds to the required cooling capability while giving enough depth to the passage.

In the W/J spacer 40, the partitioning protrusions 44, 46 are constructed so as to satisfy requirements same as those for the partitioning members 12, 14 in the first embodiment. In other words, the partitioning protrusions 44, 46 divide the ringed coolant water passage 16 into the first passage 22 and the second passage 24 like the partitioning members 12, 14 in the first embodiment when the W/J spacer 40 is put into the passage. The configuration of the present embodiment, therefore, can achieve the same effects which are achieved in the first embodiment.

[Alternatives]

It should be noted that gaps remain even after completion of the warming up between the wall of the ringed coolant water passage 16 and the partitioning protrusions 44, 46 in the second embodiment, likewise in the case of the first embodiment, according to the above described explanation. However, the present invention is not limited to this. That is, the gaps discussed above may vanish at the time of completion of warming up in the extent that breaking stress due to thermal expansion does not occur, if the problem of overheat of the partitioning protrusions 44, 46 due to accumulation of heat does not arise after completion of the warming up.

Third Embodiment.

Figure 4A:
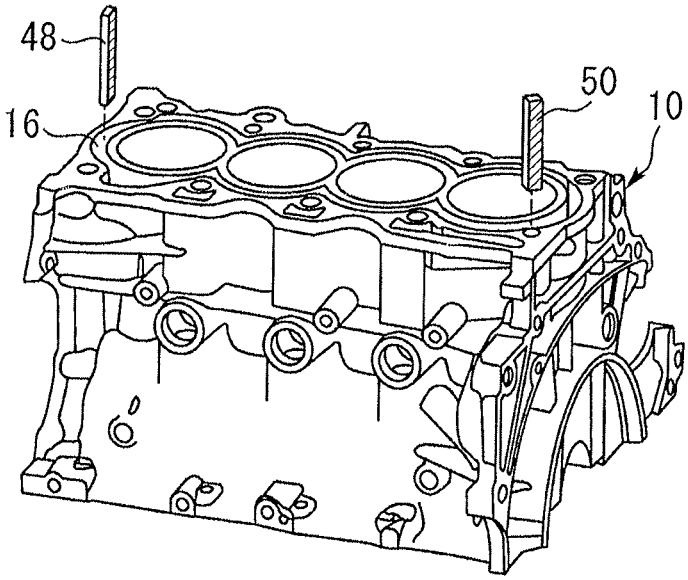
FIG. 4A is a drawing showing a cylinder block and partitioning members employed in a third embodiment of the present invention.
Figure 4B:
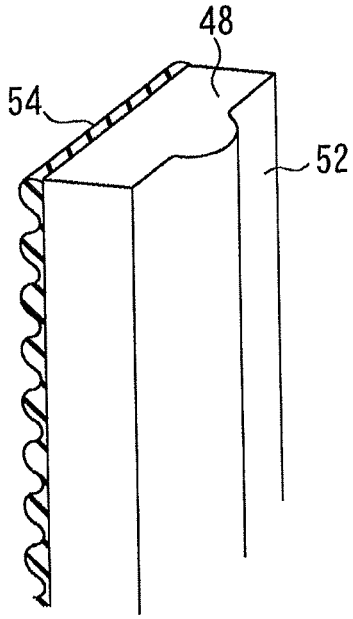
FIG. 4B is a perspective view showing the partitioning members employed in the third embodiment of the present invention.

Next, there will be explained a third embodiment of the present invention, with reference to FIG. 4A and FIG. 4B. FIG. 4A shows the cylinder block 10 and partitioning members 48, 50 employed in the present embodiment. Further, FIG. 4B is a perspective view of the partitioning member 48 used in the present embodiment. The internal combustion engine according to the present embodiment can be realized by replacing the partitioning members 12, 14 with the partitioning members 48, 50, in the configuration of the first embodiment described above.

As shown in FIG. 4A, the partitioning members 48, 50 are put into the ringed coolant water passage 16 at positions same as those of the partitioning members 12, 14 in the first embodiment. The ringed coolant water passage 16, therefore, is divided into the first passage 22 and the second passage 24 (see, FIG. 1B) also in the present embodiment when the partitioning members 48, 50 are attached.

The partitioning member 48 in the present embodiment includes a main body 52 with high rigidity and an elastic portion with high elasticity as shown in FIG. 4B. The main body 52 is formed of PP, PA66, PA6, PA66GF33 or the like as same as the partitioning members 12, 14 in the first embodiment are. On the other hand, the elastic portion 54 is made of a heat-resisting rubber or the like.

The partitioning member 48 having the configuration discussed above can be manufactured by, for example, forming an elastic body made of rubber or the like on the formed main body 52 by injection molding. Alternatively, such a partitioning member 48 can be manufactured by providing the main body 52 with a trench and fitting an elastic body made of rubber or the like into the trench. Besides, the partitioning member 48 in the present embodiment can be manufactured by providing one of the main body 52 and the elastic portion 54 with a concave portion while providing the other with a convex portion and fitting them up together.

The elastic portion 54 is constructed so that its cross section has a rippled shape as shown in FIG. 4B. Further, the partitioning member 48 in the present embodiment is configured so that mountain parts of the elastic portion 54 transform slightly when being put into the ringed coolant water passage 16 under normal temperature. In this case, gaps are secured by valley parts of the elastic portion 54 between the wall of the ringed coolant water passage 16 and the partitioning member 48.

Even more particularly, the elastic portion 54 in the present embodiment is configured so that thermal expansion occurring to the partitioning member 48 during the process of the warming up can be absorbed by deformation of its mountain parts. Thus, according to the configuration of the present embodiment, a gap remains in the vicinity of the partitioning member 48 while the partitioning member 48 does not suffer from the breaking stress at the time of completion of the warming up, likewise in the case of the first embodiment.

As described above, the partitioning member 48 in the present embodiment entirely satisfies the first through third requirements which are imposed on the partitioning members 12, 14 in the first embodiment. The other partitioning member 50 employed in the present embodiment has a configuration same as that of the partitioning member 48. Thus, the configuration of the present embodiment can entirely achieve the effects implemented by the first embodiment.

Even more particularly, the configuration of the present embodiment can prevent the partitioning members 48, 50 from chattering in the ringed coolant water passage 16. Thus, the present configuration can improve silent ability of the internal combustion engine as compared to the case of the first embodiment.

[Alternatives]

It should be noted that although gaps are remained after completion of the warming up between the wall of the coolant water passage 16 and the partitioning members 48, 50 in the above described third embodiment 3, the present invention is not limited to this. That is, the gaps discussed above may vanish at the time of completion of the warming up in the extent that breaking stress due to thermal expansion does not occur, if the problem of overheat of the partitioning members 48, 50 due to accumulation of heat does not arise after completion of the warming up.

Further, although the main bodies 52 of the partitioning members 48, 50 are made of a material showing a larger expansion coefficient as compared to that of the cylinder block 10 in the above described third embodiment, the present invention is not limited to this. That is, the partitioning members 48, 50 may be made of a same material as that of the cylinder block 10, under a condition in which sufficient bubble removable effect and enough cooling capability can be obtained even if a gap in a cold state is the same as a gap in a warmed up state.

Further, although the main body is equipped with the elastic portion 54 of the one face thereof in the above described third embodiment, the present invention is not limited to this. That is, the elastic portion 54 may be attached to the other side of the main body 52. Besides, the elastic portion 54 may be attached to the both side of the main body 52.

Forth Embodiment.

Figure 5:
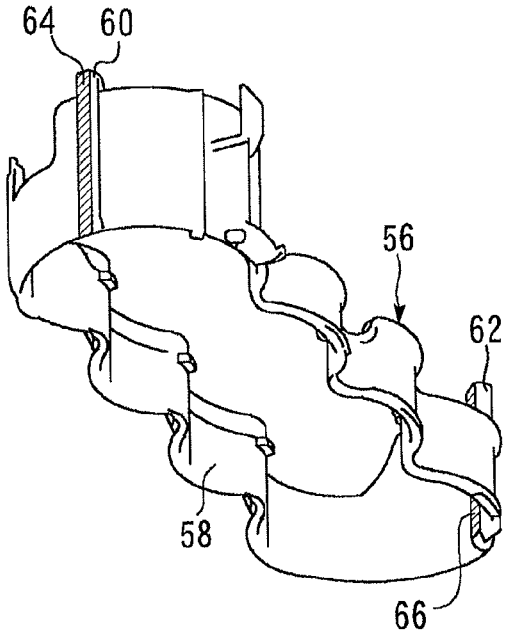
FIG. 5 is a perspective view from a down oblique direction showing a W/J spacer employed in a fourth embodiment of the present invention.

Next, a fourth embodiment of the present invention will be described, with reference to FIG. 5. FIG. 5 is a perspective view from a down oblique direction showing a W/J spacer 56 employed in the present embodiment. The W/J spacer 56 of the present embodiment includes a main body 58 and partitioning protrusions 60, 62. The partitioning protrusions 60, 62 are provided with elastic portions 64, 66, respectively, at positions contacting to the wall of the ringed coolant water passage 16. The elastic portions 64, 66 can be attached to the main body 58 by injection molding, fitting up using a trench, or fitting up using a convex portion and a concave portion, likewise the elastic portion 54 in the third embodiment. The configuration of the present embodiment is similar to the configuration of the second embodiment except that the elastic portions 64, 66 are attached to the W/J spacer 56.

The elastic portions 64, 66 satisfy the same requirements as those for the elastic portion 54 in the above described third embodiment. As a result, the W/J spacer 56 of the present embodiment will entirely satisfy the requirements imposed on the W/J spacer 40 in the second embodiment. Thus, the configuration of the present embodiment can achieve the effects achieved by the configuration of the second embodiment and the effects achieved by the third embodiment entirely.

[Alternatives]

It should be noted that gaps remain even after completion of the warming up between the wall of the ringed coolant water passage 16 and the partitioning protrusions 60, 62 in the second embodiment, likewise in the case of the first embodiment, according to the above described explanation. However, the present invention is not limited to this. That is, the gaps discussed above may vanish at the time of completion of warming up in the extent that breaking stress due to thermal expansion does not occur, if the problem of overheat of the partitioning protrusions 60, 62 due to accumulation of heat does not arise after completion of the warming up.

Fifth Embodiment.

Figure 6:
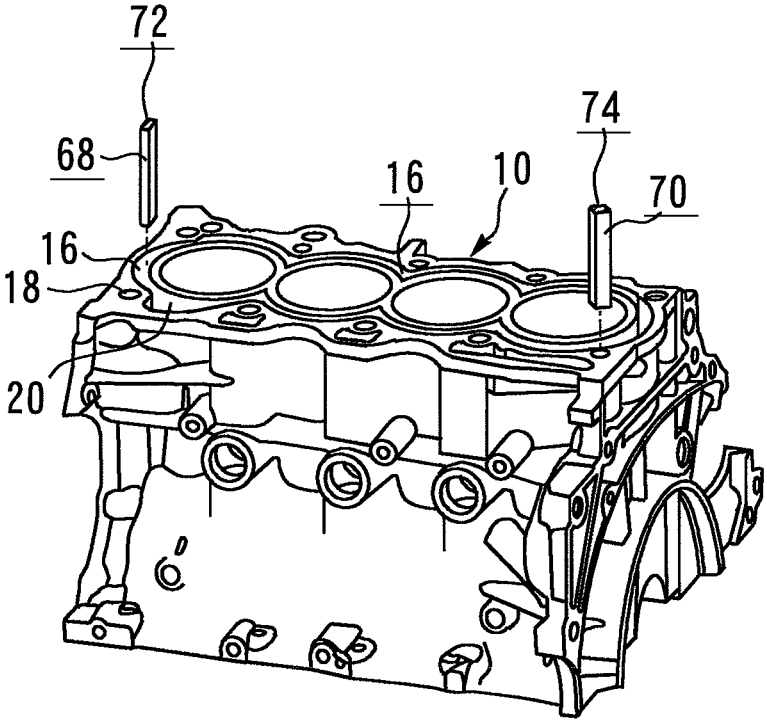
FIG. 6 is a drawing showing a cylinder block and partitioning members employed in a fifth embodiment of the present invention.

Next, a fifth embodiment of the present invention will be explained, with reference to FIG. 6. FIG. 6 is a drawing showing the cylinder block 10 and partitioning members 68, 70 employed in the present embodiment. The internal combustion engine according to the present embodiment can be realized by replacing the partitioning members 12, 14 with the partitioning members 68, 70, in the configuration of the first embodiment described above.

The partitioning members 68, 70 in the present embodiment are provided with elastic portions 72, 74 at the top thereof. The elastic portions 64, 66 can be attached by the technique such as injection molding, likewise the elastic portion 54 in the third embodiment. The configuration of the present embodiment is similar to the configuration of the first embodiment except that the elastic portions 72, 74 are attached to the partitioning members 68, 70.

A cylinder-head (not shown) is placed on the top of the cylinder block 10 while a head gasket is placed between them. The more the top face positions of the partitioning members 68, 70 accord with the face of the cylinder block 10, the better the contact condition of the head gasket. It is necessary to strictly control the fabrication tolerances of the cylinder block 10, (the bodies of) the partitioning members 68, 70, and the head gasket in order to satisfy the requirement without employing the elastic portions 72, 74.

In contrast, the fluctuation of face due to the fabrication tolerance can be absorbed by the elastic portions 72, 74 if the elastic portions 72, 74 are attached to the top of the partitioning members 68, 70. According to the configuration of the present embodiment, therefore, a satisfied contact condition can be obtained at the head gasket without requiring strict control of the fabrication tolerance.

It should be noted that, although the elastic portions 72, 74 which contact to the gasket is applied to the configuration of the first embodiment in the above described fifth embodiment, the present invention is not limited to this. That is, the elastic portions 72, 74 contacting to the gasket can be applied to the configuration according to any one of second through fourth embodiments.

Sixth Embodiment.

Figure 7:
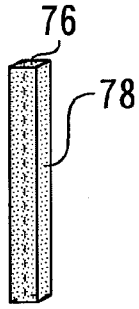
FIG. 7 is a perspective view showing a partitioning member employed in the sixth embodiment of the present invention.

Next, a sixth embodiment of the present invention will be explained, with reference to FIG. 7. FIG. 7 is a perspective view of a partitioning member 76 employed in the present embodiment. The internal combustion engine according to the present embodiment can be realized by replacing the partitioning members 12, 14 with the partitioning member 76, in the configuration of the first embodiment described above.

The partitioning member 76 in the present embodiment includes a main body made of PP or the like and a coating film 78 formed around the main body. The coating film 78 is formed of a high heat conduction material such as copper. The partitioning member 76 can prevent the difference of coolant water temperature or of wall temperature between the first passage 22 and the second passage 24 from becoming overmuch.

In particular, internal combustion engines specified for cold region use may be equipped with a heater to warm its engine block at the time of staring. In the above described first embodiment, for example, it is possible to warm the coolant water in the second passage by providing a heater to the intake side of the internal combustion engine. However, it is impossible to effectively warm the coolant water in the first passage 22 since heat conduction is disturbed by the partitioning members 12, 14.

In contrast, according to the configuration of the present embodiment, heat can be efficiently exchanged between the first passage 22 and the second passage 24 through the coating film 78 of the partitioning member 76. Thus, according to this configuration, it is possible to effectively warm the coolant water in the first passage 22 and the coolant water in the second passage 24 together by the heater placed to only one side of the internal combustion engine. Therefore, this configuration can effectively decrease the friction at the time of cold staring; thereby achieving an effect of oil consumption cutting, too.

Further, according to the partitioning member 76 described above, even in a case where the coolant water can not circulate well around it, it is possible to prevent the coolant water from being overheated locally without modifying the route of the circulation.

Figure 8:
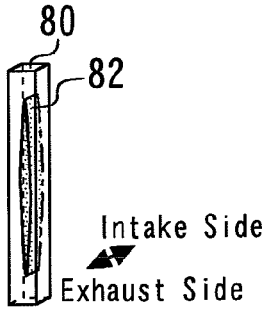
FIG. 8 is a perspective view showing a first variation of the partitioning member employed in the sixth embodiment of the present invention.
Figure 9:
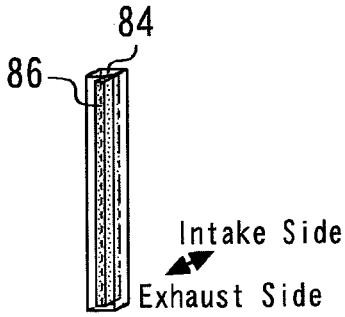
FIG. 9 is a perspective view showing a second variation of the partitioning member employed in the sixth embodiment of the present invention.
Figure 10:
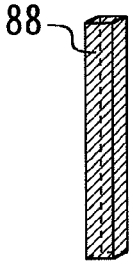
FIG. 10 is a perspective view showing a third variation of the partitioning member employed in the sixth embodiment of the present invention.

FIG. 8 through FIG. 10 show alternatives of the partitioning member 76, which can be used in the present embodiment. The partitioning member 80 shown in FIG. 8 includes a core member 82 which penetrates through its maim body and is exposed to the intake side and the exhaust side. The partitioning member 84 shown in FIG. 9 has a similar core member 86. In these examples, the core members 82, 86 are made of a high heat conduction material such as copper. Further, the partitioning member 88 shown in FIG. 10 is formed of a material in which carbon nanotubes are orientationally dispersed within a parent material for securing a high thermal conductivity between the intake side and the exhaust side. According to these partitioning members 76, 80, 84, 88, the effects like those achieved by the partitioning member 76 shown in FIG. 7 can be achieved.

It should be noted that, although the configuration in which thermal conductivity of the partitioning member is improved is applied to the configuration of the first embodiment in the above described fifth embodiment, the present invention is not limited to this. That is, the configuration in which thermal conductivity of the partitioning member is improved can be applied to the configuration according to any one of second through fourth embodiments.

Seventh Embodiment.

Figure 11:
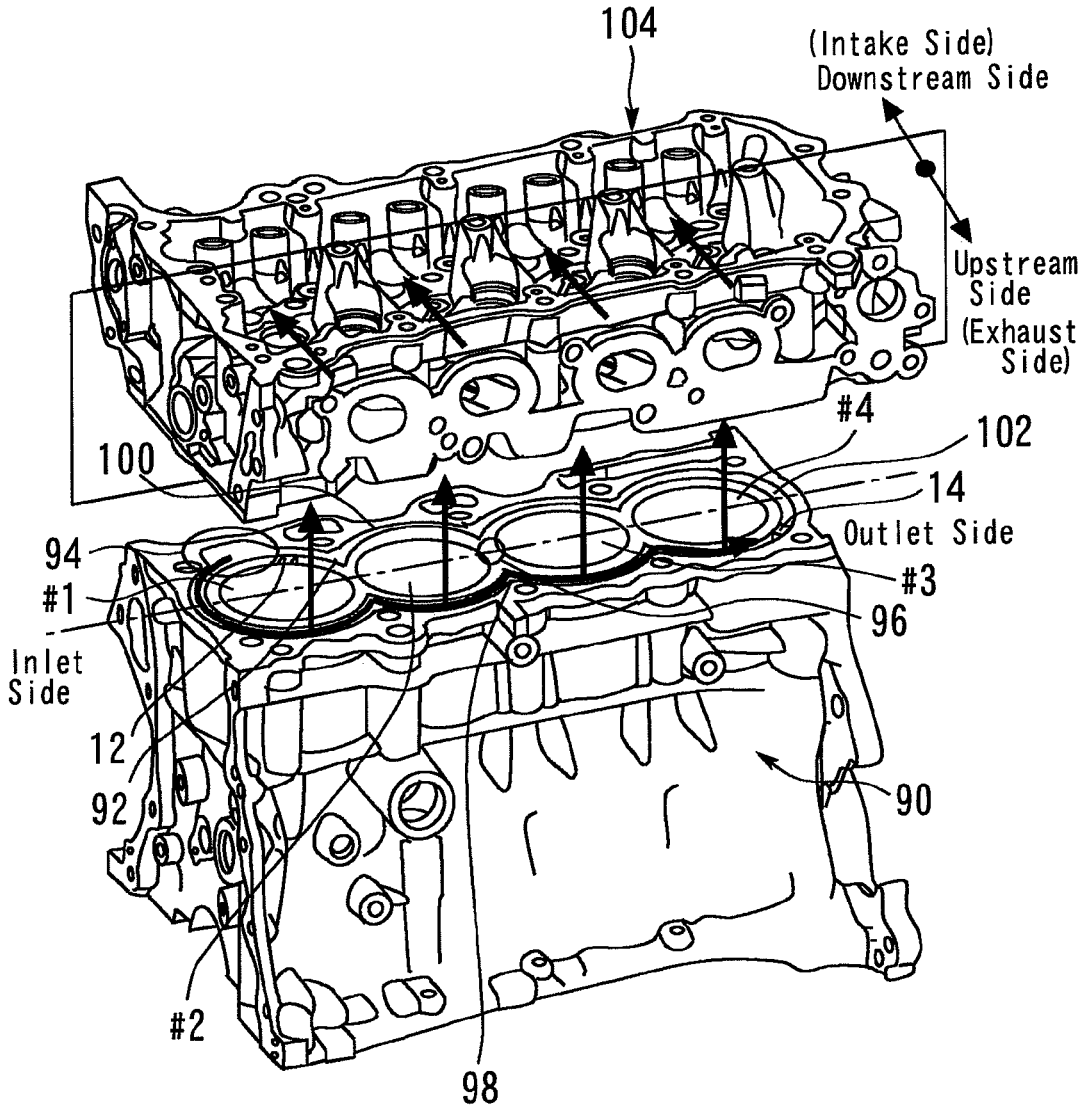
FIG. 11 is a drawing showing a cylinder block, partitioning members attached to the cylinder block, and a cylinder head, which are employed in a seventh embodiment of the present invention.

Referring to FIG. 11, a seventh embodiment of the present invention will be explained next. FIG. 11 is a drawing for describing the configuration of the internal combustion engine according to the present embodiment. The internal combustion engine according to the present embodiment includes a cylinder block 90. Similar to FIG. 1, FIG. 11 shows the cylinder block 90 so that the front side in the drawing becomes exhaust side of the internal combustion engine and the back side in the drawing becomes intake side of the internal combustion engine.

The cylinder block 90 has a ringed coolant water passage 92 which was formed so as to surround four cylinders #1-#4. A connecting portion 94 to connect an inlet (not shown) of coolant water to the ringed coolant water passage 92 is provided in the intake side (back side in the drawing) of the cylinder #1. The cylinder block 90 in the present embodiment differs from the cylinder block 10 in the first embodiment in the point that the connecting portion 94 is provided in the intake side as thus described.

The ringed coolant water passage 92 is equipped with the partitioning members 12, 14 which are similar to those employed in the first embodiment. One partitioning member 12 is placed near the #1 side end portion, while the other partitioning member 14 is placed near the #4 side end portion.

More specifically, the partitioning member 12 is placed at a position satisfying the following two requirements.

1. Being in the intake side (back side in the drawing) of the longitudinal bore center plane of the cylinder block 90.

2. Being at a position where is closer to the engine center 96 than the connecting portion 94 communicating with the inlet.

Here, the engine center 96 means the longitudinal direction center of the cylinder block 90, that is, the middle between the cylinder #2 and the cylinder #3 in the present embodiment.

Further, the partitioning member 14 is placed at a position satisfying the following two requirements.

1. Being in the exhaust side (front side in the drawing) of the longitudinal bore center plane of the cylinder block 90.

2. Being in the outlet side of a crosswise bore center plane of the cylinder which locates nearest to the outlet (the cylinder #4 in the present embodiment).

Here, the outlet of the coolant water is provided at the cylinder #4 side end surface of the internal combustion engine; and the above described outlet side means the side of the end surface where the outlet is provided. Further, the crosswise bore center plane means a plane which is perpendicular to the longitudinal bore center plane and goes through a bore center of any one of cylinders.

The ringed coolant water passage 92 is divided into a first passage 98 extending mainly in the exhaust side (front side in the drawing) and a second passage 100 extending mainly in the intake side (the back side in the drawing), when being provided with the partitioning members 12,14 as above. More specifically, the first passage 98 is formed so as to communicate with the connecting portion 94 in the intake side of the cylinder #1 and extend along the exhaust side of the cylinder #1-#4 by coming around the side region of the cylinder #1. On the other hand, the second passage 100 is formed so as to slightly overlap with the side region of the cylinder #1, extend along the intake side of the cylinders #2-#4, come around the side region of the cylinder #4, and reach to the region of the exhaust side by exceeding the longitudinal bore center plane. Hereinafter, the region exceeding the longitudinal bore center plane to come around into the exhaust side (the region from the longitudinal bore center plane to the partitioning member 14) and its symmetrical region in the intake side to the longitudinal bore center plane are totally referred to as "come around portion 102".

In the present embodiment, the cylinder block 90 is equipped with a cylinder head 104 thereon. The cylinder head 104 includes a coolant water passage (not shown) to connect the exhaust side and the intake side, likewise the cylinder head 28 in the first embodiment (see, FIG. 2A). This coolant water passage becomes communicated with the first passage 98 in exhaust side and with the second passage 100 in the intake side when the cylinder head 104 is put on the cylinder block 90. The cylinder head 104 is also provided with a draining passage which communicates with the come around portion 102 of the second passage under the above described situation. The draining passage communicates with the outlet installed in the cylinder head 104.

In the present embodiment, it shall be required to circulate the coolant water through the internal combustion engine by a technique of the breadthwise flowing directing from the exhaust side toward the intake side. On the other hand, the installation position of the water pump shall be decided to the intake side of the internal combustion engine due to various limitations such as position arrangement of intake pipes or exhaust pipes, installation direction of the internal combustion engine, or the like. Under these requirements and the limitations, it is necessary to make the coolant water taken from the intake side of the internal combustion engine go around into the exhaust side once, and then flow through by the breadthwise flowing technique.

According to the configuration of the present embodiment, the first passage 98 mainly extending along the exhaust side of the cylinder block 90 goes around the side region of the cylinder #1 so as to communicate with the connecting portion 94 in the intake side. Thus, according to this configuration, it is possible to make coolant water go around into the exhaust side by simply supplying coolant water to the connecting portion 94 which is installed in the same side as that of the water pump. That is, according to this configuration, it is possible to make coolant water go around from the intake side to the exhaust side of the cylinder block 90 without installing further guidance pipes or the like. Thus, the internal combustion engine according to the present embodiment can realize efficient breadthwise flowing of coolant water without being accompanied with the great increase of parts number or production cost under the above described requirements and limitations.

Further, the configuration of the present embodiment can suppress the total volume of the coolant water passage to low level as compared to a case in which a guidance pipe is newly installed to make the coolant water go around from the intake side to the exhaust side. Because of this, the configuration of the present embodiment can reduce the total amount of the coolant water needed in the internal combustion engine, thereby being able to improve the warming up characteristic of the internal combustion engine.

Further, in the configuration of the present embodiment, the partitioning member 14 of the #4 side is placed at the exhaust side of the longitudinal bore center plane, as stated above. As a result, the come around portion 102 extending largely in the crosswise direction is formed at the side region of the cylinder #4. In other words the configuration of the present embodiment secures the come around portion 102 having a large surface by making the second passage 100 go around long toward the crosswise direction at the side region of the cylinder #4 without executing measures such as widening the width of the ringed coolant water passage 92 at the side region of the cylinder #4.

In the present embodiment, the coolant water, which is supplied from the inlet, then arrives at the second passage 100, is drained from the draining passage after going through the come around portion 102. It is necessary to give a large surface to the come around portion 102 in order to sufficient coolant water draining ability in this stage. However, if the requirement will be satisfied by enlarging the width of the ringed coolant water passage 92 in a side region of the cylinder #4, the distance from the cylinder #4 to the end portion of the cylinder block 90 is enlarged, whereby the internal combustion engine is grown in size. Even more particularly, in that case, the total volume of the coolant water passage is enlarged; thereby increasing the coolant water amount contained in the cooling mechanism.

In contrast, according to the configuration of the present embodiment, the internal combustion engine needs not to be grown in size as well as the cooling water amount to be needed is not increased, since there is no need to widen the ringed coolant water passage 92. When the coolant water amount can be suppressed to low level, the internal combustion engine can be light weighted, as well as the warming up characteristics of the internal combustion engine can be improved. Because of this, the configuration of the present embodiment can realize an internal combustion engine which is small, light weighted, and outstanding in warming up characteristics.

It should be noted that, although the ringed coolant water passage 92 is divided into the first passage 98 and the second passage 100 by the partitioning member 12, 14 in the first embodiment in the above described seventh embodiment, the present invention is not limited to this. That is, the configuration of partitioning member for separating the first passage 98 and the second passage 100 is not limited to the configuration of the first embodiment but may be the configuration of the partitioning member or the partitioning protrusion employed in any one of the second through sixth embodiments.

The invention claimed is:

1. An internal combustion comprising:

a cylinder block equipped with a ringed coolant water passage formed so as to surround a plurality of cylinders;

two partitioning members having a larger thermal expansion coefficient as compared to that of said cylinder block, and separating said ringed coolant water passage into a first passage existing mainly at one side of a longitudinal bore center plane which extends along the longitudinal direction of said cylinder block and a second passage existing mainly at the other side of said longitudinal bore center plane;

an inlet which communicates with said first passage;

an outlet which communicates with said second passage; and a cylinder head provided with a coolant water passage opening to both said first passage and said second passage, wherein a gap is continuously or intermittently formed between said cylinder block and an entirety of said partitioning member under a cold condition.

2. The internal combustion engine according to claim 1, wherein at least one of said cylinder block and said partitioning member includes stress lowering means which absorb, by elastically deforming, a relative dimensional change occurring between the said cylinder block and said partitioning member between a cold condition and a warmed up condition.

3. The internal combustion engine according to claim 1, wherein at least a portion of the gap remains between said cylinder block and said partitioning member under a warmed up condition.

4. The internal combustion engine according to claim 1, wherein said partitioning member comprises a main body having rigidity and an elastic portion attached to said main body.

5. The internal combustion engine according to claim 1, wherein said partitioning member is formed of a base material and a heat conduction material having high heat conductivity as compared to that of the base material so as to show a high heat conductivity as compared to that of the base material itself between said first passage and said second passage.

6. The internal combustion engine according to claim 1, wherein said inlet is provided in said other side at a vicinity of a longitudinal directional end of said cylinder block, and one of said two partitioning members is placed in said other side at a place which is closer to the center of the internal combustion engine than a connecting portion of said inlet and said ringed coolant water passage.

7. The internal combustion engine according to claim 1, wherein said inlet is provided at a vicinity of one end in a longitudinal direction of said cylinder block, said outlet is provided at a vicinity of the other end in the longitudinal direction of said cylinder block, one of said two partitioning members is placed at a vicinity of said inlet, and the other of said two partitioning members is placed in said one side at a position which is closer to said outlet than an other-end crosswise bore center plane which is perpendicular to said longitudinal bore center plane while extending through a bore center of the cylinder closest to said other end in the longitudinal direction.

* * * * *